United States Patent [19]

Thompson

[11] Patent Number: 4,776,412

[45] Date of Patent: Oct. 11, 1988

[54] NOZZLE ASSEMBLY FOR ROTARY DRILL BIT AND METHOD OF INSTALLATION

[75] Inventor: Charles M. Thompson, Houston, Tex.

[73] Assignee: Reed Tool Company, Houston, Tex.

[21] Appl. No.: 150,283

[22] Filed: Jan. 29, 1988

[51] Int. Cl.[4] ..... E21B 10/60

[52] U.S. Cl. ..... 175/393; 175/424; 239/600; 239/601

[58] Field of Search ..... 175/393, 339, 340, 424; 239/597, 598, 600, 601; 166/222, 223

[56] References Cited

U.S. PATENT DOCUMENTS

| | | | |
|---|---|---|---|
| 3,120,284 | 2/1964 | Goodwin | 239/600 |
| 3,137,354 | 6/1964 | Crawford et al. | 175/340 |
| 3,447,755 | 6/1969 | Cartwright | 239/600 X |
| 4,400,024 | 8/1983 | Ratcliff et al. | 285/356 |
| 4,427,221 | 1/1984 | Shay | 175/340 X |
| 4,533,005 | 8/1985 | Morris | 175/393 |
| 4,542,798 | 9/1985 | Madigan | 175/340 |
| 4,582,149 | 4/1986 | Slaughter, Jr. | 239/600 X |
| 4,687,067 | 8/1987 | Smith et al. | 175/424 X |
| 4,738,320 | 4/1988 | Bardin et al. | 175/393 X |

*Primary Examiner*—Stephen J. Novosad

*Attorney, Agent, or Firm*—Dodge, Bush & Moseley

[57] ABSTRACT

A rotary drill bit (10) has a nozzle assembly (24) positioned within a nozzle bore (22). Nozzle assembly (24) has a nozzle member (34) with a port (40) deviated from the longitudinal axis of the nozzle member (34). A retaining nut (54) is threaded within the threaded bore (22) while the nozzle member (34) is held against rotation thereby to maintain the port (40) in a predetermined rotational position upon final installation.

11 Claims, 4 Drawing Sheets

NOZZLE ASSEMBLY FOR ROTARY DRILL BIT AND METHOD OF INSTALLATION

BACKGROUND OF THE INVENTION

This invention relates to a nozzle assembly for a rotary drill bit and method of installation, and more particularly to such a nozzle assembly and method in which the nozzle assembly has a port oriented for discharging drilling fluid in a predetermined rotational position with respect to the longitudinal axis of the nozzle assembly.

Heretofore, much as shown in U.S. Pat. No. 4,533,005 dated Aug. 6, 1985, nozzle assemblies have been provided in which an inner nozzle member could be rotated relative to an outer securing ring or sleeve threaded within an internally threaded nozzle bore in the bit body for properly orienting the port in the nozzle member. However, the inner nozzle member for such externally threaded nozzle assemblies has rotated with the nozzle assembly during insertion or installation of the nozzle assembly within the nozzle bore. Then, after the initial installation, the nozzle member is rotated relative to the outer retaining sleeve or nut for proper orientation. In the event the nozzle member is not tightly secured, and particularly after long periods of use, the nozzle member may rotate and thus result in a disorientation of the deviated port.

In aforesaid U.S. Pat. No. 4,533,005 the nozzle member is held against rotation primarily by the compression of an adjacent O-ring. Such an arrangement, when the nozzle port is deviated at a relatively large angle and utilized with a high velocity drilling fluid may result in a disorientation of the nozzle port, particularly upon vibrations resulting from the drilling operation after prolonged periods of use and compression set of the O-ring.

SUMMARY OF THE INVENTION

The present invention is directed particularly to a nozzle assembly for a rotary drill bit and method of installation, and particularly to a nozzle assembly which is received within a nozzle bore in the bit body for receiving pressurized drilling fluid being directed against a formation in the cutting operation.

The improved nozzle assembly includes a nozzle member having a nozzle port therethrough oriented at a predetermined rotational position for installation against a counterbore in the nozzle bore. A separate retaining nut receiving the nozzle member has external screw threads for engaging internal screw threads of the bore for being threaded within the bore in a tight fitting relation therein. The retaining nut and nozzle member have opposed facing abutting shoulders and upon the inward threading of the retaining nut, the nozzle member urges the contacting opposed shoulders into a tight secured position in the bore against the counterbore thereof. During such rotation of the retaining or lock nut into tight fitting relation, the nozzle member is held against rotation with its port in a predetermined oriented position for directing the flow of drilling fluid from the port in a predetermined pattern or direction.

Thus, upon the retaining nut being threaded into its final tight fitting relation within the nozzle bore, the nozzle member and associated nozzle port are in a tight secured position and do not require any further orientation. Even with high velocity drilling fluid being discharged through the nozzle port, the nozzle member comprising the present invention remains tightly secured and does not tend to rotate from its secured position. To prevent rotation of the nozzle member during the threading of the retaining nut within the nozzle bore, the nozzle member includes means to receive a tool or the like for preventing such rotation. Such means to prevent the rotation of the nozzle member during insertion of the retaining nut may comprise a positioning groove or projection within the bore or suitable openings or the like in the nozzle member to receive a tool.

It is an object of this invention to provide a nozzle assembly for a rotary drill bit and method of installation in which the nozzle assembly has an oriented port for discharging drilling fluid from a predetermined rotational position with respect to the longitudinal axis of the nozzle assembly.

An additional object of this invention is to provide such a nozzle assembly and method of installation in which the nozzle member having the oriented port therein is held against rotation during installation of the nozzle assembly into tight fitting relation.

An additional object of the invention is to provide such an improved nozzle assembly in which an externally threaded retaining nut receives the nozzle member and engages internal screw threads in the nozzle bore for installation of the nozzle assembly upon rotation of the retaining nut relative to the nozzle member while urging the nozzle member into a tight fitting relation within the adjacent bore during installation of the nozzle assembly.

Other objects, features, and advantages of this invention will become more apparent after referring to the following specification and drawings.

Figure 1:
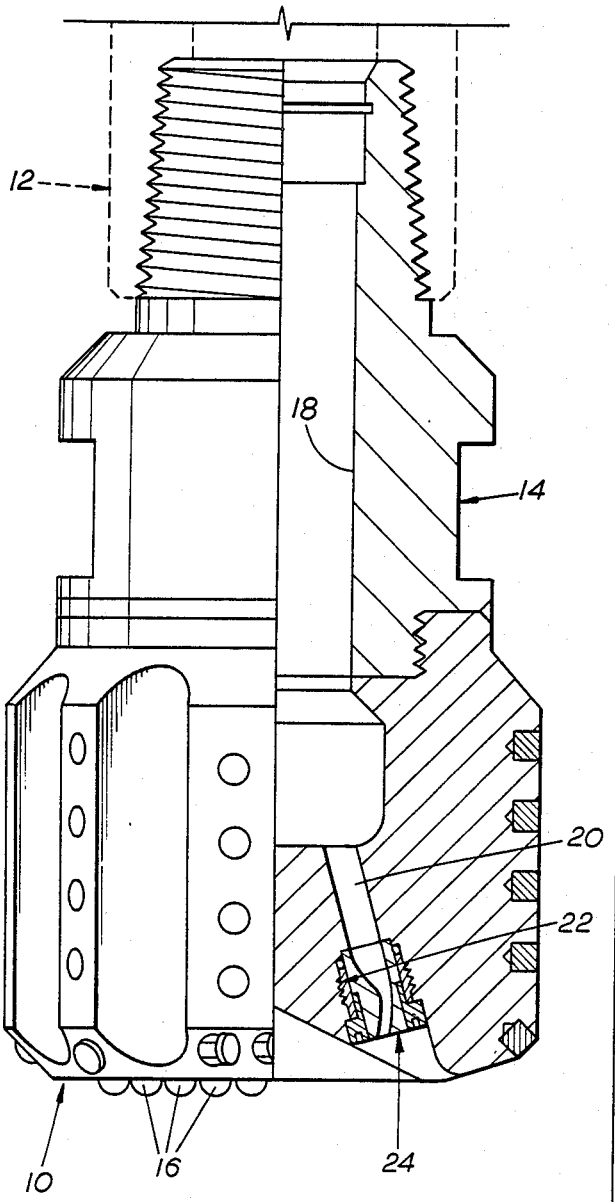
FIG. 1 is a elevation of a drag type rotary drill bit with a portion broken away and illustrating a nozzle assembly comprising the present invention within a nozzle bore in the bit body.
Figure 3:
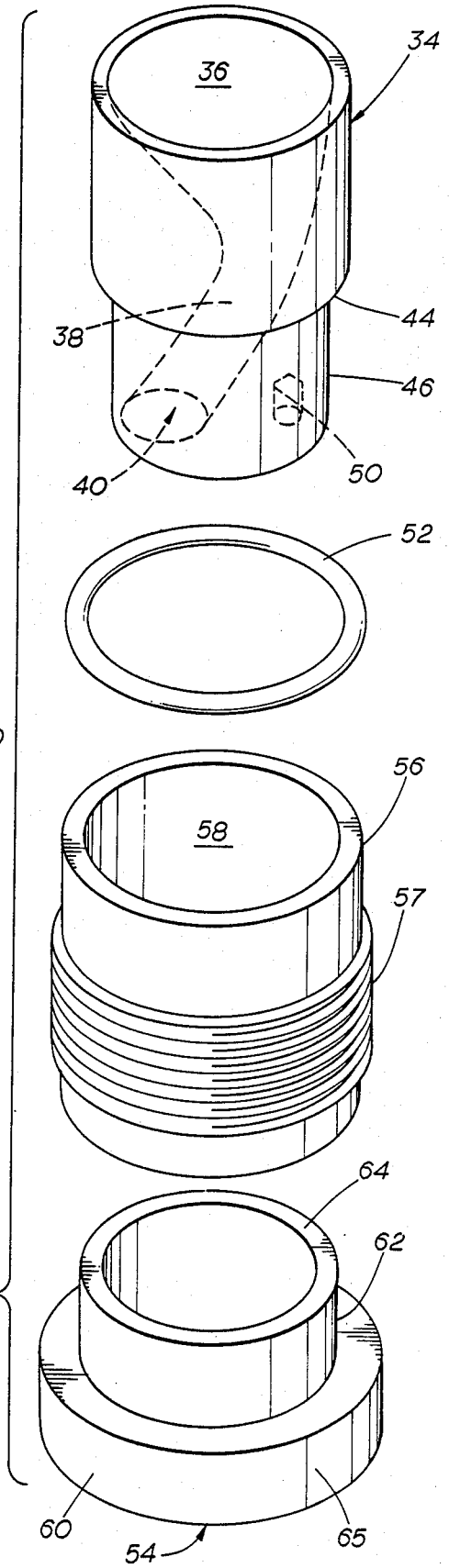
FIG. 3 is an exploded view of the nozzle assembly shown in FIG. 2 illustrating the elements of the nozzle assembly removed from the bore opening.
Figure 2:
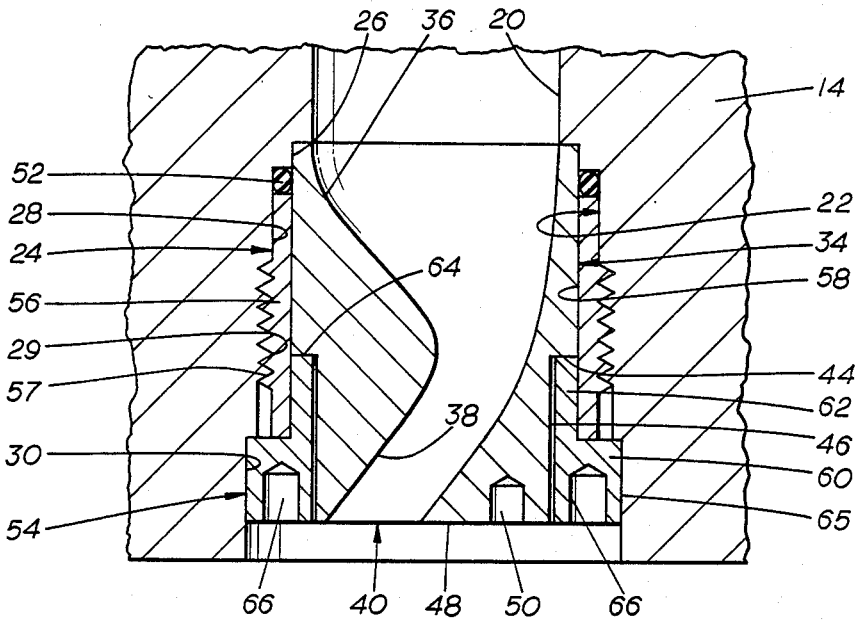
FIG. 2 is an enlarged fragment of FIG. 1 showing the improved nozzle assembly in section positioned within the nozzle bore of the bit body.

Referring now to the drawings and more particularly to FIG. 1, a rotary drill bit of the so-called drag drill bit type is shown generally at 10 connected to the end of a drill string at 12. Drill bit 10 has a bit body 14 with a plurality of cutting elements shown at 16 extending from the outer face of bit body 14. Cutting elements 16 may be provided with diamond cutting faces mounted on studs which are received within suitable openings in bit body 14 as well known. Drilling fluid is provided from a surface location through a central main flow passage shown at 18 and a plurality of branch flow passages 20 communicating with main passage 18. Each branch flow passage 20 terminates at a nozzle bore generally indicated at 22 in bit body 14.

Figure 6:
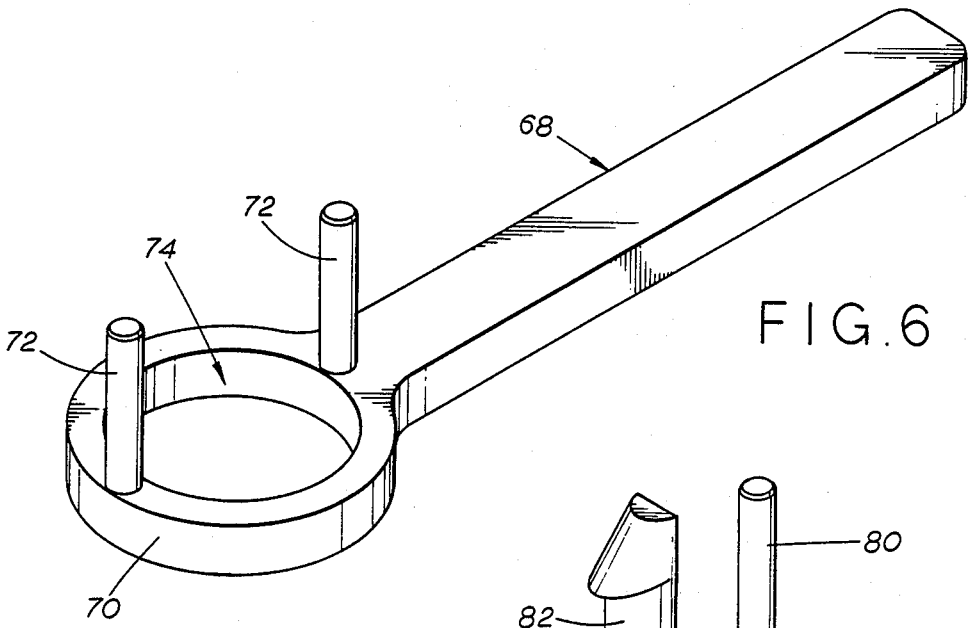
FIG. 6 is a perspective of a spanner wrench having a pair of prongs thereon and forming the tool for rotating the nozzle assembly.
Figure 7:
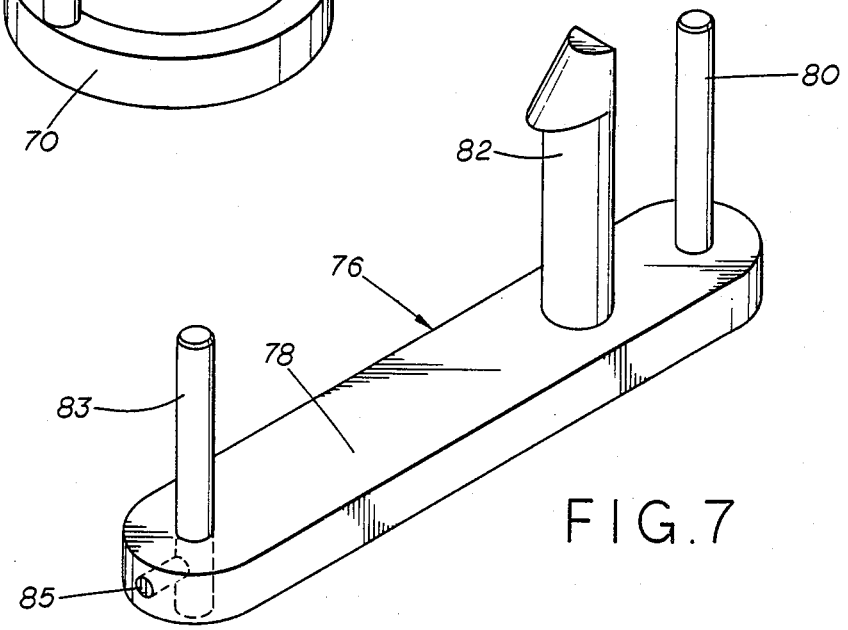
FIG. 7 is a perspective of the other tool engaging the inner nozzle member of the nozzle assembly to hold the nozzle member against rotation as the nozzle assembly is being threaded within the nozzle bore.

A nozzle assembly generally indicated at 24 is positioned within nozzle bore 22. FIGS. 2–5 show a preferred embodiment of nozzle assembly 24 while FIGS. 6 and 7 show tools for installing nozzle assembly 24 of FIGS. 2–5 within nozzle bore 22. Nozzle bore 22 includes an inner small diameter counterbore 26, an intermediate counterbore 28 having internal screw threads 29, and a large diameter outer counterbore 30.

Nozzle assembly 24 includes a nozzle member generally designated 34 formed of a hard metal such as tungsten carbide with abrasion resistance to the high velocity drilling fluids. Nozzle member 34 includes an inner large diameter bore portion 36 leading to an outer small diameter bore portion 38 having a port or orifice 40 deviated from the longitudinal axis of nozzle member 34. An outer annular shoulder or abutment 44 is provided adjacent a reduced diameter outer end portion 46 of nozzle member 34. End portion 46 has an outer face 48 with an opening 50 therein to receive a suitable tool as will be explained further. An O-ring 52 seals between the outer peripheral surface of nozzle member 34 and the adjacent surface of bit body 14 defining bore 22.

A retaining-lock nut is generally indicated at 54 and includes an externally threaded sleeve 56 having external screw threads 57 for engaging nternal threads 29 of intermediate counterbore 28 and defining a central bore 58 receiving nozzle member 34. Nut 54 further includes an outer generally cylindrical body 60 with an inner end portion 62 fitting within sleeve 56 and forming a radially extending internal or inner shoulder 64 for abutting contact with adjacent shoulder 44 on nozzle member 34. Body 60 is brazed or bonded to outer sleeve 56 and forms with sleeve 56 a one piece construction for retaining nut 54. Cylindrical body 60 has an outer flange 65 having a plurality of openings 66 therein adapted to receive a suitable tool as will be explained. While body 60 is normally formed of a hard carbide material, it may, if desired, be formed of the same material as sleeve 56 which is normally steel.

Referring now to FIG. 6, an installation tool is shown at 68 in the form of a spanner wrench including an annular body 70 having a pair of prongs 72 extending therefrom and defining a central opening 74. Prongs 72 are adapted to fit within an opposed pair of openings 66 of retaining nut 54 for manual rotation of retaining nut 54. In order to hold nozzle member 34 against rotation with retaining nut 54 during final assembly after orientation, a second tool is shown in FIG. 7 indicated generally at 76 including a relatively flat body portion 78 having a pair of prongs 80 and 82 projecting therefrom. Prong 80 is adapted for fitting within opening 50 in nozzle member 34 while prong 82 is adapted for fitting within port 40 of nozzle member 34. Further, a removable alignment prong or marker 83 secured by set screw 85 is provided for holding tool 76 and port 40 in the oriented position during installation of nozzle assembly 24. Suitable spaced markings or openings 84 may be provided for alignment with prong 83 at a desired orientation of port 40. Alignment marker 83 may be removed to permit tool 68 to be rotated past three hundred sixty (360) degrees.

Figure 4:
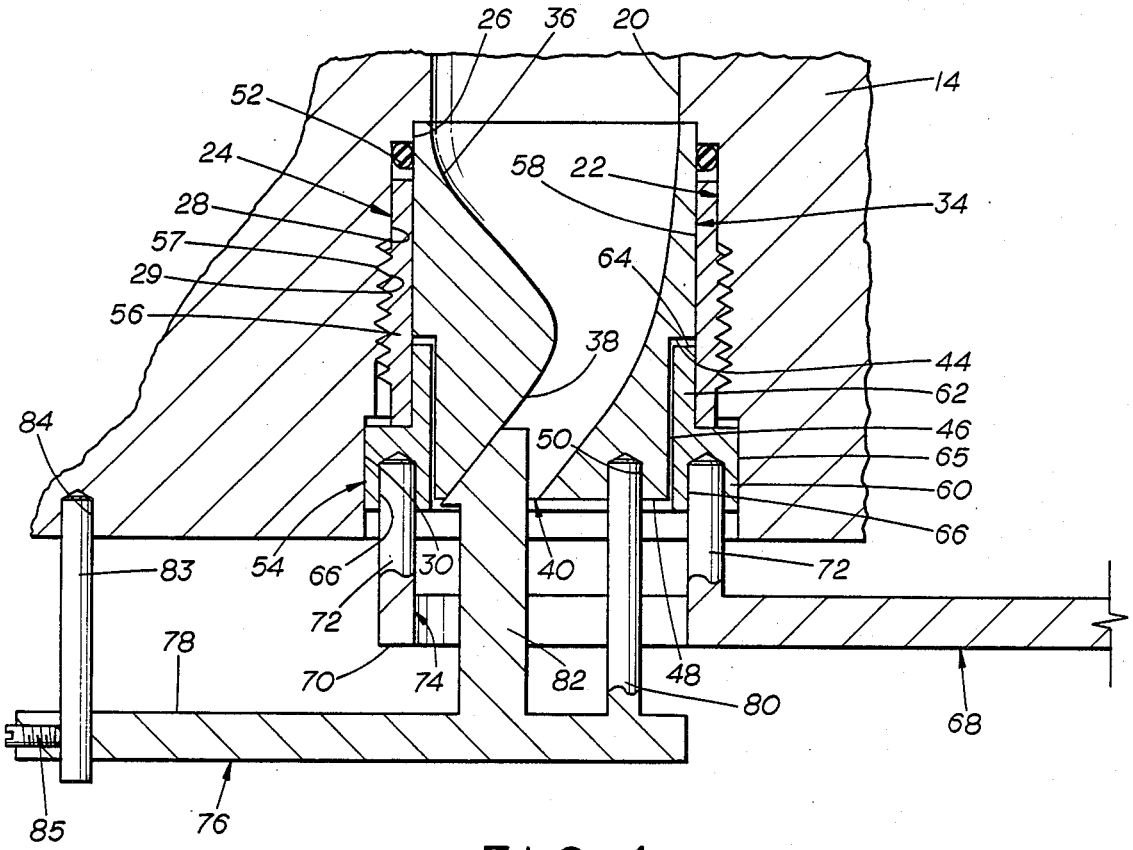
FIG. 4 is a sectional view similar to FIG. 2 but illustrating installation tools engaging the nozzle assembly for installation thereof into a tight secured position within the nozzle bore while the nozzle member is held against rotation.
Figure 5:
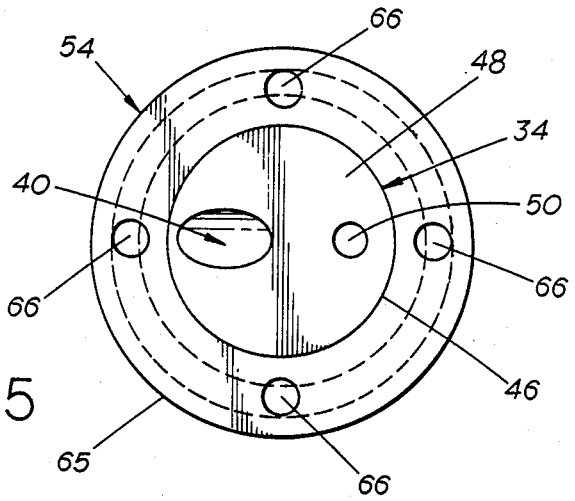
FIG. 5 is a bottom plan of a nozzle assembly showing the openings for receiving extending prongs on the installation tools shown in FIG. 4.

In operation when tools 68 and 76 are utilized for installation of nozzle assembly 24, nozzle member 34 is received within retaining nut 54 and in this position nozzle assembly 24 is manually positioned within nozzle bore 22 until the external screw threads 57 on sleeve 56 contact the internal screw threads 29 in bore 22. Next, tool 68 is utilized and prongs 72 are inserted within openings 66 of retaining nut 54. Then, tool 76 is utilized with prongs 80 and 82 being positioned within opening 74 of tool 68. Then, prong 80 is inserted within opening 50 and prong 82 is inserted within port 40 as shown in FIG. 4. In this position, nozzle member 34 is held against rotation by tool 76 while retaining nut 24 is manually rotated by tool 68. Thus, nozzle member 34 does not tend to rotate even though lower bore portion 38 and port 40 deviate from the longitudinal nal axis of nozzle member 34 and are exposed to high velocity drilling fluids for prolonged periods of time. Retaining ring 54 as well as nozzle member 24 are preferably formed of a suitable abrasion and erosion resistant material, such as a tungsten carbide with a cobalt binder. Threaded sleeve 56, may be formed of a machinable metal such as steel which may be secured to body member 60 by brazing. Body member 60 may likewise be formed preferably of an abrasion or erosion resistant material, such as tungsten carbide.

Figure 8:
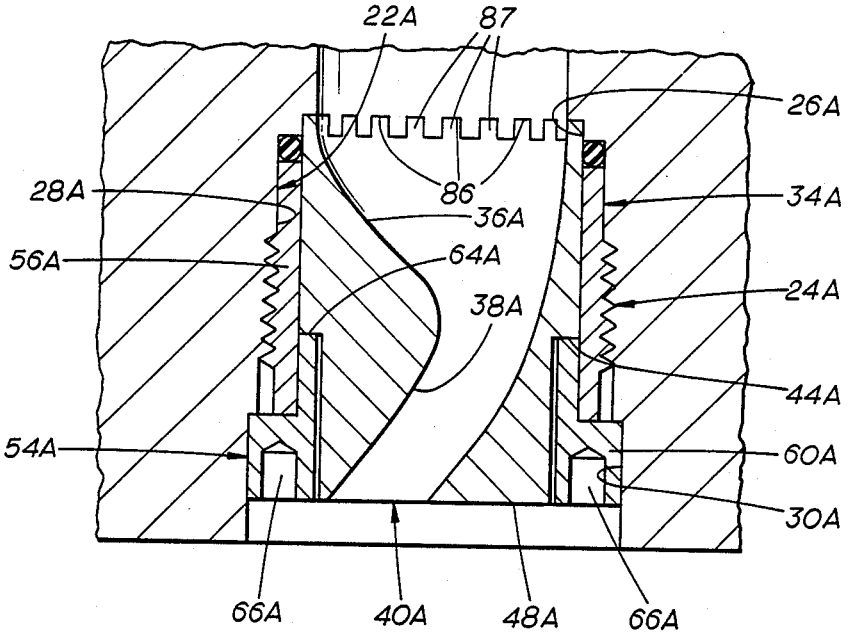
FIG. 8 is a sectional view of a modified nozzle assembly adapted to be installed with a single installation tool.
Figure 9:
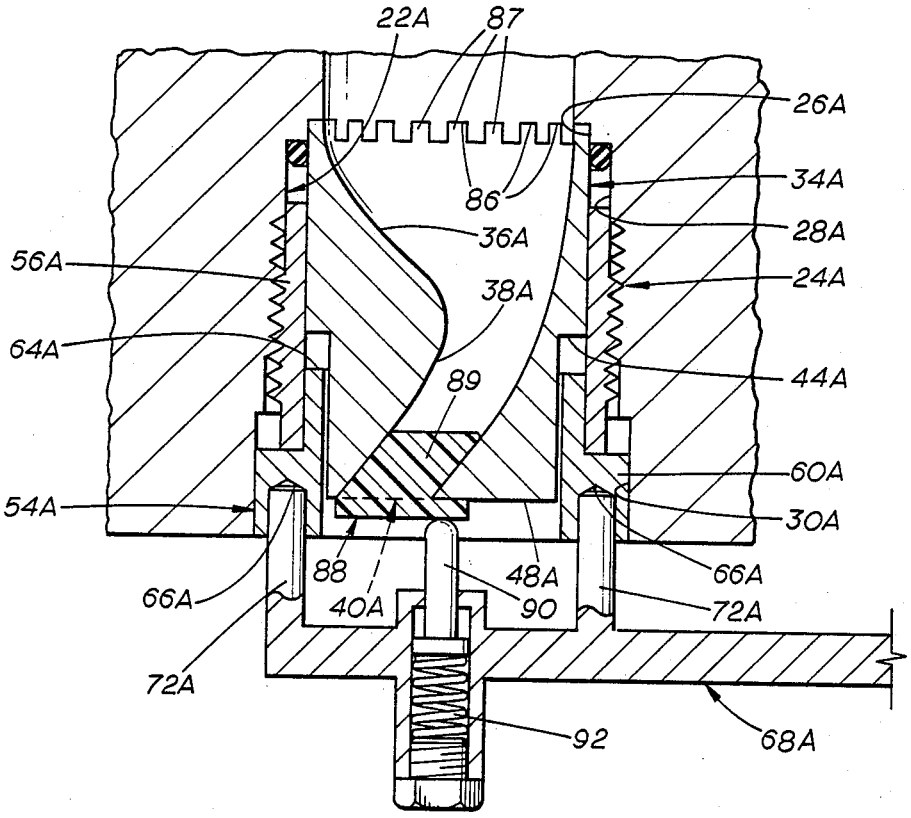
FIG. 9 is a sectional view of the embodiment shown in FIG. 8 but showing the installation tool rotating the retaining nut relative to the nozzle member for installing the nozzle assembly.

Referring now to FIGS. 8 and 9, a modified nozzle assembly 24A is illustrated which is particularly adaptable for being installed within a nozzle bore 22A by a single tool shown at 68A. Nozzle bore 22A defines an inner small diameter counterbore 26A, an intermediate counterbore 28A and a large diameter outer counterbore 30A. Inner counterbore 26A includes a plurality of slots or indentations 86 circumferentially spaced from each other at fifteen (15) degree intervals, for example. The inner circumferential surface of nozzle member 34A adjacent large diameter bore portion 36A includes a plurality of nibs or lips 87 spaced about the circumference of nozzle member 34A at fifteen (15) degree intervals, for example, and adapted to fit within cooperating slots or indentations 86 of counterbore 26A. Nozzle assembly 24A includes a nozzle member 34A having an abutting shoulder 44A and a lower bore portion 38A leading to an outer port 40A deviated from the longitudinal axis of nozzle member 34A. Retaining ring or nut 54A has a sleeve 56A secured to an outer body 60A which defines an abutting shoulder 64A in contact with shoulder 44A on nozzle member 34A. Outer body 60A has a pair of opposed openings 66A therein. A plastic insert 88 having an extension 89 is adapted to be positioned within port 40A to protect port 40A during installation of nozzle assembly 24A. An installation tool 68A has a pair of prongs 72A with a depressible plunger member 90 therebetween urged outwardly by a spring 92.

For installation of nozzle assembly 24A, prongs 72A of tool 68A are positioned within openings 66A of outer retaining nut 54A after plastic insert 88 is positioned adjacent the outer face 48A of nozzle member 34A and extension 89 is received within port 40A and bore portion 38A. Plunger 90 engages insert 88 and is urged outwardly by spring 92 for urging nozzle member 34A inwardly where nibs or lips 87 are received within associated slots 86 in bore 22A. Cooperating nibs 87 and slots 86 prevent rotation of nozzle member 34A during rotation of retaining ring 54A by tool 68A and plunger 90 maintains nibs 87 in such slots 32A. Thus abutting shoulders 44A and 64A are normally spaced during the initial installation of nozzle assembly 24A. However, during the last several turns of sleeve 56A, shoulder 64A contacts shoulder 44A and urges nozzle member 34A into tight seated engagement within bore 22A. Thus, a single tool 68A is provided which rotates retaining ring 54A while preventing nozzle member 34A from being rotated therewith. Thus, port 40A can be oriented in the desired direction for the drilling fluid upon the initial installation of nozzle assembly 24A. Insert 88 protects port 40A and bore portion 38A during the installation operation since plunger 90 tends to rotate with the rotation of tool 68A. Insert 88 may be formed by many desired materials, such as a hard plastic material, for example.

From the foregoing, it is apparent that an improved nozzle assembly has been provided by the present invention permitting nozzle members having a deviated nozzle port to be initially oriented at the beginning of the installation operation so that upon the completion of the threading of a retaining or locking nut, the nozzle member associated deviated port are in the desired oriented position tightly fitting within a nozzle bore without any further installation or orienting steps required.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. In a rotary drill bit having a body with an internally threaded nozzle bore therein for receiving pressurized drilling fluid; an improved nozzle assembly comprising:

a nozzle member having a nozzle port therethrough and positioned within the nozzle bore at a predetermined rotational oriented position with respect to the longitudinal axis of the nozzle member, said nozzle bore defining an internal shoulder for contacting said nozzle member in abutting relation upon installation of said nozzle member within said bore, said port being constructed and arranged so that upon rotation of said nozzle member about its longitudinal axis to a predetermined oriented position the stream of fluid exiting from said port is in a desired direction and pattern;

an externally threaded retaining nut for threading within said threaded bore and contacting said nozzle member for urging said nozzle member into tight abutting contact with said internal shoulder when installed; and means for preventing rotation of said nozzle member from its predetermined oriented position upon threading of said retainer nut within said bore for urging said nozzle member into tight abutting contact against said internal shoulder within the bore.

2. In a rotary drill bit as set forth in claim 1 wherein said means for preventing rotation of said nozzle member comprises interfitting projections and grooves on said body and nozzle member to prevent relative rotation of said nozzle member relative to said body during installation.

3. In a rotary drill bit as set forth in claim 1 wherein said means for preventing rotation of said nozzle member comprises a tool engaging said nozzle member and holding said nozzle member against rotation relative to said body during installation.

4. In a rotary drill bit having a body with an internally threaded nozzle bore therein for receiving pressurized drilling fluid and an internal shoulder within the bore; an improved nozzle assembly comprising:.

a nozzle member having an inner annular surface adapted to contact said internal shoulder in abutting relation upon installation and having a nozzle port therethrough adapted to be rotationally oriented within said nozzle bore, said nozzle port being constructed and arranged so that upon rotation of said nozzle member about its longitudinal axis to a predetermined position the stream of fluid exiting from said port is in a desired direction and pattern;

a retaining nut with a central bore therethrough having external threads for engaging said threaded nozzle bore and having a radially extending annular shoulder;

said nozzle member being formed of a hard erosion resistant material and having a shoulder abutting said shoulder on said retaining nut upon threading of said retaining nut within the bore for urging said nozzle member inwardly into tight abutting contact with said internal shoulder of said nozzle bore upon final installation; and means for sealing between said nozzle member and said body;

means to prevent rotation of said nozzle member upon threading said nut into tight secured position within the bore for holding said nozzle port in a predetermined oriented position for directing the flow of drilling fluid from said port in a predetermined direction and pattern.

5. In a rotary drill bit as set forth in claim 4, said retaining nut having openings therein adapted to receive prongs of an installation tool for rotation thereof.

6. In a rotary drill bit having a body and an internally threaded nozzle bore therein for receiving pressurized drilling fluid and including a counterbore defining an internal shoulder adjacent the inner end of said nozzle bore;

an improved nozzle assembly received within said nozzle bore and comprising;

a nozzle member having a nozzle port therethrough and positioned within the nozzle bore at a predetermined oriented position with respect to its longitudinal axis, said port being constructed and arranged so that upon rotation of said nozzle member about its longitudinal axis to a predetermined oriented position the stream of fluid exiting from said port is in a desired direction and pattern, and said nozzle member has an inner circumferential surface for contacting said internal shoulder in abutting relation upon installation of said nozzle member;

an O-ring positioned between the nozzle member and the bit body for sealing therebetween; and a retaining nut having a central bore therethrough and external screw threads engaging said internally threaded nozzle bore, said retaining nut having a radially extending inner shoulder;

said nozzle member being formed of a hard metallic material and having an opposed shoulder abutting said inner shoulder on said nut and being urged into a tight fitting abutting contact with the internal shoulder on said counterbore sufficient to restrict rotation of said nozzle member relative to said nut upon securement of said nut into final threaded position within said nozzle bore;

said hard metal nozzle member having means to receive a tool and prevent rotation thereof upon the threading of said nut into its tight secured position within the bore for holding said port in a predetermined oriented position during the securement of said nut whereby said nozzle member is properly oriented upon securement of said nut with respect to the longitudinal axis thereof and is tightly held against relative rotation against said internal shoulder formed by the counterbore.

7. A method of inserting a nozzle assembly within an internally threaded nozzle bore of a rotary drill bit body against a shoulder formed adjacent the inner end of the nozzle bore, the nozzle assembly including a nozzle member with a nozzle port therethrough and an externally threaded retaining sleeve for threading within said nozzle bore, the nozzle member mounted for rotation about its longitudinal axis to a predetermined oriented position of the port for the discharge of fluid in a desired direction and pattern, the nozzle member having means to receive a tool to prevent rotation thereof during insertion of the nozzle assembly and the retaining sleeve having means to receive a tool for rotation of the sleeve relative to the nozzle member during insertion of the nozzle assembly; said method comprising the following steps:

first positioning said nozzle member within said nozzle bore;

then threading said sleeve within said nozzle bore against said nozzle member; and next providing a tool for rotating said externally threaded sleeve while holding said nozzle member against rotation with its port properly oriented during rotation of said sleeve into a tight fitting secured position urging said nozzle member into tight abutting contact against said shoulder with said port properly oriented.

8. In a rotary drill bit having a body and an internally threaded nozzle bore defining an inner abutment therein; an improved nozzle assembly adapted to be received within said nozzle bore and to be positioned tightly against the abutment within said bore; said nozzle assembly comprising:

a nozzle member having a fluid flow passage therethrough terminating at a nozzle port deviating from its longitudinal axis and having an inner abutting surface thereon adapted to engage the abutment in said nozzle bore; and a retaining nut with a central bore therethrough having external screw threads for engaging said internally threaded nozzle bore and an internal shoulder extending radially inwardly from the inner circumferential surface of said nut defining said central bore;

said nozzle member having an outer shoulder abutting said internal shoulder on said retaining nut and being urged into abutting contact with said inner abutment of the nozzle bore by the retaining nut upon the inward threading of said nut within said nozzle bore, said nozzle member further having means to receive a tool and prevent rotation thereof upon the threading of said nut into a tight secured position within the bore for holding said deviated port in a predetermined oriented position for directing the flow of drilling fluid from said port in a predetermined angled relation with respect to the longitudinal axis of said nozzle member.

9. In a rotary drill bit having a body with an internally threaded nozzle bore therein for receiving pressurized drilling fluid; an improved nozzle assembly adapted to be received within said nozzle bore and comprising:

a nozzle member having a fluid flow passage therethrough terminating at its outer end at a nozzle port deviating from its longitudinal axis, said nozzle member and said body having interfitting means therebetween to prevent rotation with respect to said bit body upon installation of the nozzle assembly; and a retaining nut with a central bore therethrough and having external screw threads for engaging said internally threaded nozzle bore, said nut having means thereon engaging said nozzle member upon threading of the nut within said bore for urging said nozzle member into tight fitting relation within the bore with said interfitting means preventing rotation of said nozzle member upon installation of said retaining nut within said nozzle bore.

10. In a rotary drill bit as set forth in claim 9 wherein said retaining nut has openings therein adapted to receive an installation tool for rotation thereof, and said tool has means thereon engaging and continuously urging said nozzle member inwardly within said nozzle bore for maintaining said interfitting means in interfitting relation.

11. In a rotary drill bit as set forth in claim 9 wherein said interfitting means comprises interfitting nibs and serrations on said body and said nozzle member.

* * * * *